US005954153A

United States Patent [19]

Rogelja

[11] Patent Number: 5,954,153

[45] Date of Patent: Sep. 21, 1999

[54] DESCENDER

[76] Inventor: Boris Rogelja, 9 Nelson Ave., Padstow, Australia

[21] Appl. No.: 08/843,737

[22] Filed: Apr. 21, 1997

[30] Foreign Application Priority Data

Apr. 22, 1996 [AU] Australia ..... PN9430

[51] Int. Cl.[6] ..... A63B 29/00

[52] U.S. Cl. ..... 182/5; 182/93; 188/65.5

[58] Field of Search ..... 182/5, 72, 193; 188/65.5, 65.4, 65.3

[56] References Cited

U.S. PATENT DOCUMENTS

| | | | |
|---|---|---|---|
| 383,211 | 5/1888 | Calkins . | |
| 785,202 | 3/1905 | Dalquist . | |
| 1,216,041 | 2/1917 | Abramson . | |
| 4,596,314 | 6/1986 | Rogelja | 188/65.5 |
| 5,597,052 | 1/1997 | Rogelja | 188/65.4 |

*Primary Examiner*—Alvin Chin-Shue
*Attorney, Agent, or Firm*—Klein & Szekeres, LLP

[57] ABSTRACT

A descender for use in abseiling comprises;

a base having a connection means for connection to a harness or the like; and a pivotal member pivotally mounted on the base about a pivot axis extending generally normal thereto, the pivot axis being spaced from the connection means.

The pivotal member defines first and second spaced sheaves for engaging a rope, extending generally parallel to the pivot axis. The first sheave is disposed about the pivot axis and the second sheave is located substantially on the opposite side of the pivot axis with respect to the connection means. The pivotal member also has a handle means to selectively pivot the pivotal member relative to the base;

The base further has a first stop defining a braking surface located adjacent the second projection which limits movement of the pivotal member; and a further, second stop disposed adjacent the first stop at a greater distance from the second projection than the first stop.

In use, a rope passing around and between the first and second projections and between the second projection and the first stop, and between the first stop and the second stop will have a resistance force applied thereto which is at a maximum when the handle means is released and the tension of the rope causes the second projection to bear against the first stop which presses the rope between the braking surface and the second projection. The resistance force can be controlled by moving the tail of the rope as it emerges from the descender between the first stop and the second stop.

4 Claims, 3 Drawing Sheets

DESCENDER

TECHNICAL FIELD

The present invention relates to "descenders" for use in abseiling and in particular to all improved descender of the type which incorporates a self-acting brake.

BACKGROUND TO THE INVENTION

Abseiling is a technique used to descend steep surfaces such as cliff faces and is often used by persons involved in activities such as mountain climbing, canyoning and caving. In order to abseil down a cliff face, one end of a rope is made fast at the top of the cliff and the person making the descent then slides down the rope. The rope is passed either around the body of the person or more usually through a descender attached to a harness worn by the person such that the passage of the rope around the body or through the descender provides sufficient friction to slow the rate of descent to a safe speed.

A descender comprises rope engaging surfaces around and between which the rope travels, along a tortuous path, to provide frictional engagement between the rope and the descender. The rate of descent is normally controlled by holding the free or tail end of the rope to control the tension on the rope where it emerges from the descender and thereby to control the degree of frictional engagement between the rope and the descender which in turn controls the rate of descent.

Descenders used in abseiling vary greatly in performance and complexity, there being a variety of relatively simple devices which rely on frictional engagement between the rope and metal rings or racks about which the rope is wrapped, and a number of more complex descenders which incorporate a braking mechanism which allows the friction between the rope and the descender to be varied other than by simply controlling the free or tail end of the rope. The earliest of these more complex devices had a handle or lever which when operated tended to increase the friction between the descender and the rope. This type of descender was not a great improvement over the more simple devices as the brake was not self-engaging and therefore, if the user was knocked unconscious, he would fall in the same way as the user of the earlier devices.

The present invention is derived from a class of descenders wherein the variable braking action of the descender increases when the handle is released. Usually, the force required to initiate the braking action is provided by the frictional engagement of the descender with the rope travelling therethrough. It is also possible to have arrangements which are operated by springs. Spring operated arrangements have the disadvantage that the restoring force of the spring may reduce with age or the spring may become damaged without this being noticed by the user, thereby decreasing the effectiveness of the descender.

An improved type of descender was disclosed in U.S. Pat. No. 4,596,314 to the present applicant which provides a descender having a simplicity of construction and operation which was not achieved by earlier prior art descenders. U.S. Pat. No. 4,596,134 describes a descender for use in abseiling which includes a base having a connection means for connection to a harness and a pivotal member pivotally mounted on the base about a pivot axis extending generally normal to the base, the pivot axis being spaced from the connection means. The pivotal member has first and second spaced projections for engaging a rope, the projections both extend generally parallel to the pivot axis with the first projection being disposed about the pivot axis and the second projection being located on the opposite side of the pivot axis with respect to the connection means: The pivotal member defines a handle means to selectively pivot the pivotal member relative to the base. The base further includes a stop located adjacent the second projection which limits movement of the pivotal member.

In use, a rope passing around and between the first and second projections and between the second projection and the stop surface had a resistance force applied thereto which was a maximum when the handle means was released and the tension of the rope causes the second projection to bear against the stop and press the rope between the stop and the second projection. The disclosure of this United States patent is incorporated herein by reference.

A disadvantage of the descender disclosed in U.S. Pat. No. 4,596,314 is that the actuation and release of the self-engaging brake can in some situations be rather abrupt or jerky. For example, it can be difficult for inexperienced users to smoothly control the braking action. Also the descender exhibits a tendency to fall very quickly when the brake is released.

An improved type of descender was disclosed in U.S. Pat. No. 5,597,052. That descender provided a modification to the descender shown in U.S. Pat. No. 4,596,314 which allowed the user to smoothly control the braking action and thereby avoid or minimise the jerkiness.

The improvement relied on replacing the stop surface by a variable braking mechanism having braking surface defined by a cam pivotally mounted on the base, controlled by a handle/lever. While this descender is an improvement over the descender shown in U.S. Pat. No. 4,596,314, substantial additional manufacturing costs are associated with the provision of the cam surface and associated lever. Also the provision of two handles on the descender can make the device more complicated to understand and use, particularly for the inexperienced users, for whom the device is intended.

DISCLOSURE OF THE INVENTION

The present invention provides a descender for use in abseiling comprising;

a base having a connection means for connection to a harness or the like:

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed about the pivot axis and the second projection being located substantially on the opposite side of the pivot axis with respect to the connection means; the pivotal member also having a handle means to selectively pivot the pivotal member relative to the base;

the base further having a first stop defining a braking surface located adjacent the second projection which limits movement of the pivotal member; and a further or second stop adjacent the first stop;

whereby, in use, a rope passing around and between the first and second projections and between the second projection and the first stop, and between the first stop and the second stop will have a resistance force applied thereto which is at a maximum when the handle means is released and the tension of the rope causes the second projection to bear against the first stop which presses the rope between the braking surface and the second projection and wherein the resistance force can be controlled by moving the tail of the rope as it emerges from the descender between the first stop and the second stop.

Surprisingly, it has been found that if the descender of U.S. Pat. No. 4,596,314 is provided with a second stop disposed adjacent the first stop between which stops the rope emerges from the descender, variable braking can be smoothly provided without the need for the relatively expensive cain surface and lever arrangement of U.S. Pat. No. 5,597,052.

Apart from being cheaper to manufacture a further advantage of the arrangement described above is that the second stop means will normally be disposed on the base plate at a greater distance from the second projection than the first stop means. If the rope bypasses the first stop means and passes between the gap between the second projection and the second stop means, less braking force is applied to the rope. This is useful if a light person, such as a small child is to make descent, or where a long descent say 200 m is being made where the weight of the rope will brake the device.

Preferably, the first and second projections define sheaves which are fixed relative to the pivotal member.

BRIEF DESCRIPTION OF THE DRAWINGS

Preferred forms of the present invention will now be described by way of example with reference to the accompanying drawings, wherein.

BEST MODE OF CARRYING OUT THE INVENTION

Figure 1:
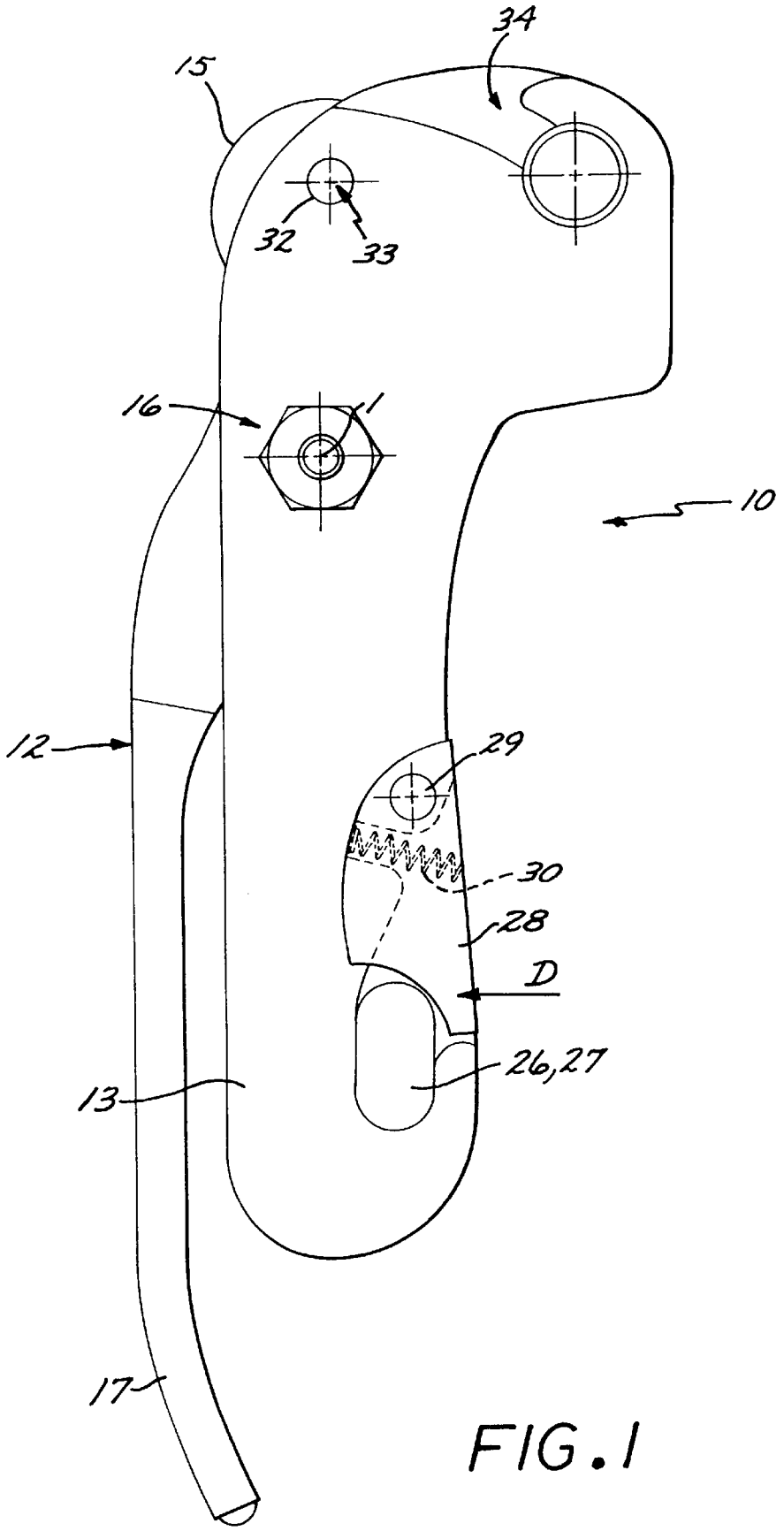
FIG. 1 is a top plan view of a first embodiment of the descender with the retention plate in its closed position.
Figure 2:
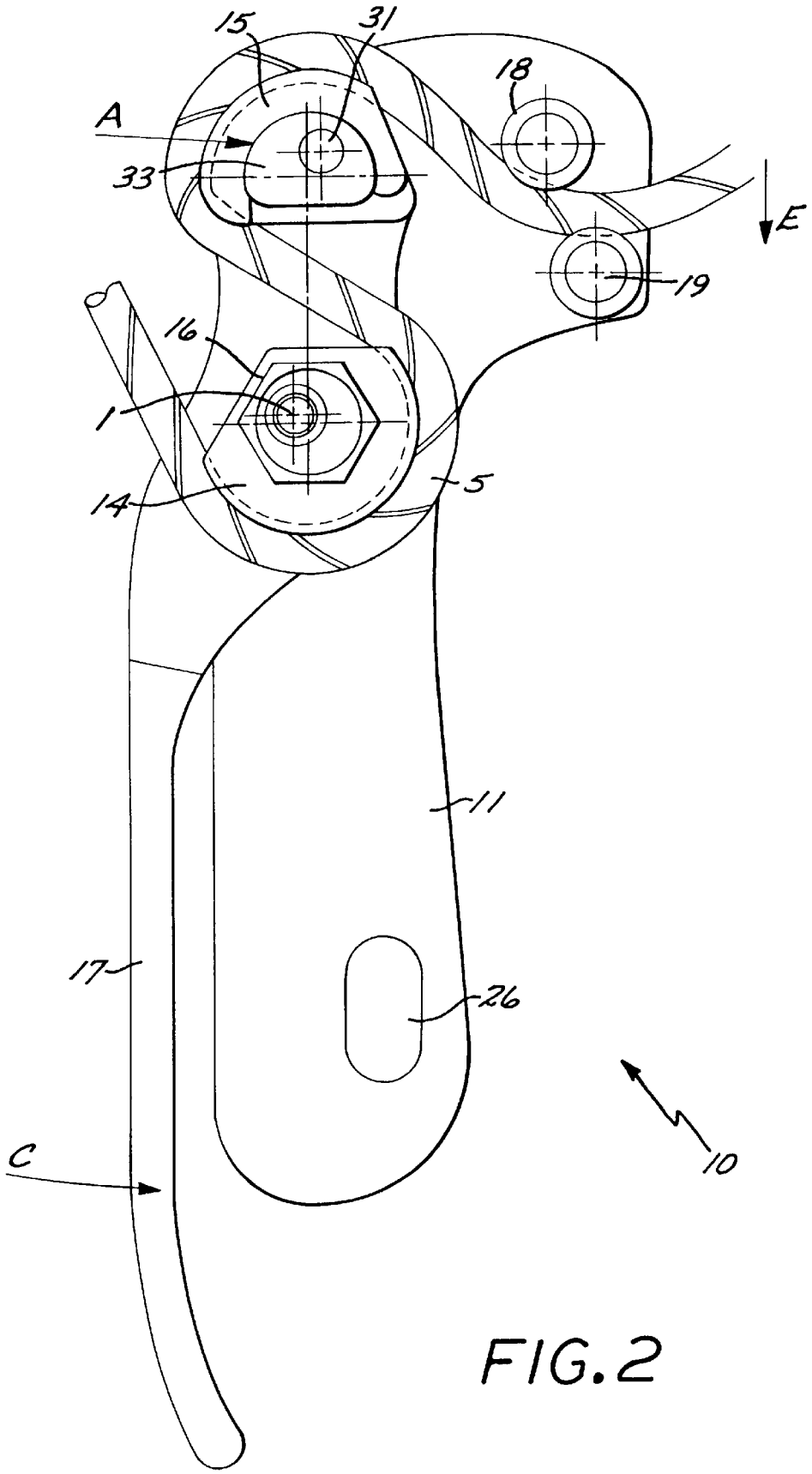
FIG. 2 shows the descender of FIG. 1 with the retention plate removed.
Figure 3:
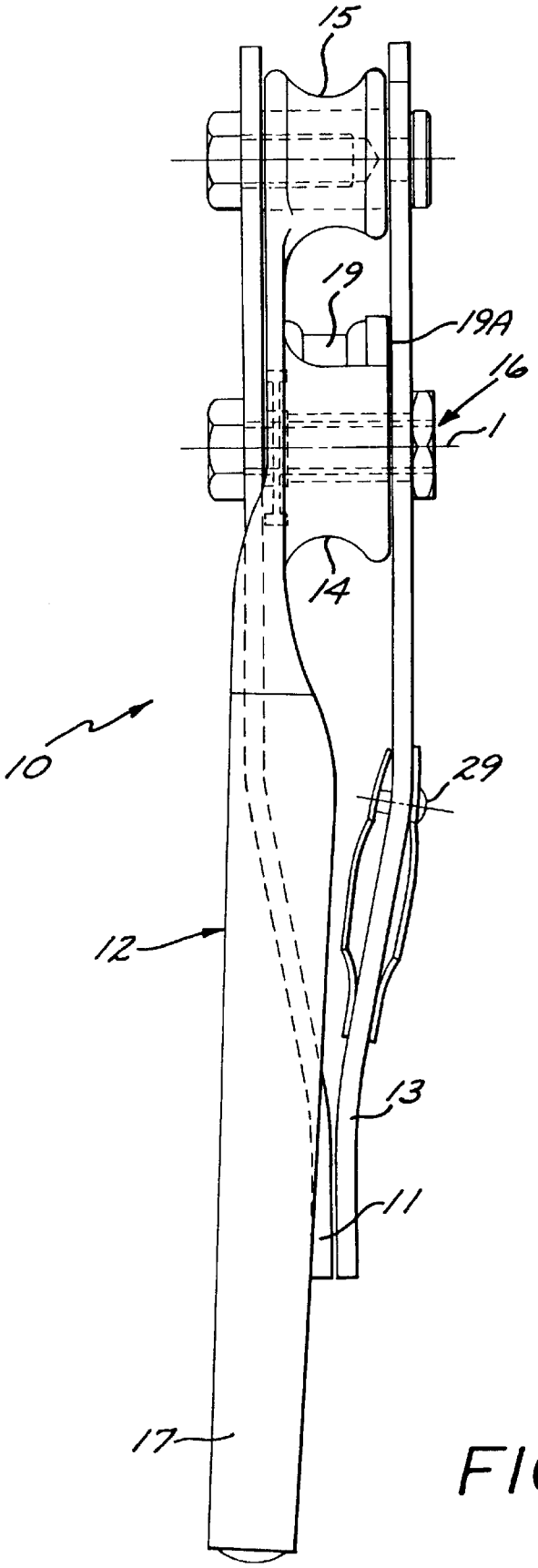
FIG. 3 shows a side elevational view of the descender of FIG. 1.

Referring to FIGS. 1–3. there is shown a descender 10 having a base plate 11, a pivotal member 12, and a retention plate 13.

The pivotal member 12 includes two spaced, non-rotatable sheaves 14 and 15 and is pivotally mounted to the baseplate 11 by a pivot arrangement 16 about a pivot axis 1. The effective centre of the first sheave 14 is either co-axial with, or slightly offset from, the pivot axis 1.

The pivotal member 12 extends away from the first sheave 14 in a generally opposite direction to the second sheave 15 to provide a lever handle 17 which, when moved in the direction C with respect to the baseplate 11, moves the second sheave 15 to a position remote from a first stop member 18 of the baseplate 11.

A second stop member 19 also extends from the base plate 11. As oriented in FIG. 2, it is disposed generally below the first stop member 18, and at a greater distance from the second sheave than the first member.

The retention plate 13 is pivotal about the same pivot axis 1 as the pivotal member 12 which allows the rope to be inserted into and removed from the descender 10 when in the open position (not shown). When the retention plate 13 is pivoted to a closed position (refer FIG. 1) it covers the gap between the two sheaves 14 and 15, the gap between the second sheave 15 and the first stop member 18, and the gap between the first stop member and the second stop member 19 to prevent the rope from accidentally jumping out of the descender during a descent. When in the closed position, a slot 34 in the retention plate 13 engages stop member 18 in a groove formed in the stop member. In this way, the retention plate 13 is securely supported and reduces the tendency for the plate 13 to twist due to side loading of the descender by the rope. As can be seen in FIG. 3, the height of the second stop member 19, (i.e. the distance of the top of the stop member is spaced from the base plate), is such that the retention plate can slide over the top 19A of the same.

The baseplate 11 is provided with an elongated hole 26 by which the descender 10 can be permanently connected to a harness during use, the connection normally being made by way of a carabinier. The retention plate 13 is provided with a slot 27 which opens through one side of the plate 13, the slot 27 being closed off by a closure member 28 pivotally connected to the plate 13 by a rivet 29 and which is biased into the closed position by a spring 30. To move the retention plate 13 to the closed position, the closure member 28 is pivoted in direction D and the carabinier which is already connected in the hole 26 of the baseplate 11 is passed through the opening in the slot 27. The closure member 28 is then released to retain the carabinier in the slot 27. To reopen the descender, the closure member is again depressed in the direction D and the carabinier removed from the slot 27 as the retention plate 13 is pivoted to the open position.

The baseplate 11 and retention plate 13 are also provided with holes 31,32 such that the braking action of the descender 10 may be inhibited by passing a carabinier or other suitable device through the hole 31 in the baseplate, an opening 33 which extends through the centre of the second sheave 15 and the hole 32 in the retention plate 13 so as to hold the pivotal member 12 relative to the baseplate 11 and maintain the second sheave 15 away from the stop member 18 of the baseplate 11.

During use of the descender 10, a rope 5 is passed around the first sheave 14 between the first and second sheaves 14, 15, around the second sheave 15, between the second sheave 15 and the first stop member 18, and between the first stop member and the second stop member 19 as shown in FIG. 2.

A minimum braking force is obtained when the handle is pulled in the direction C towards the base and retention plates 11, 13 so as to move the second sheave 15 into a position remote from the stop member. It will be recognised, however, that even under the minimum braking situation described, the speed of travel of the rope through the descender 10 can be controlled by varying the tension on the tail of the rope 5.

Pushing the tail end of the rope down wards in the direction E will increase the braking force. Lifting the tail end of the rope upwards, in the opposite direction will reduce the braking force.

When the handle 17 is released, the tension on the rope 5 and the above described tortuous path of the rope 5 through the descender 10 causes the pivotal member 12 to pivot so that the second sheave 15 is urged into contact with the stop member 18 (or the rope 5 which is therebetween). In this position of the handle 17, the rope 5 is pressed between the second sheave 15 and the braking surface of the stop member 18 which will create an additional braking force on the rope 5 and which is preferably sufficient to stop the descent of the user.

It will be appreciated that the provision of the second stop member 19 prevents very rapid uncontrolled descent which can occur with descenders such as that described in U.S. Pat. No. 4,596,314. In this way the variable descender allows an inexperienced user to smoothly control the application of the additional braking force and thereby avoid jerky stops and starts which can be experienced when operating the descender 10 with the handle 17.

In the case where a light person such as a small child, is using the descender or in the case where a long descent for example 200 m is being made where the weight of the rope hanging from the descender will brake the device, the rope 5 may pass between sheave is and the second stop member 19, by passing the first stop member 18, which allows the rope to run more freely through the descender.

It will be appreciated by persons skilled ill the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A descender for connecting a harness to a rope and operating on the rope during abseiling, the descender comprising:

a base having a connection means for connecting to said harness;

a pivotal member pivotally mounted on the base about a pivot axis extending generally normal thereto, the pivot axis being spaced from the connection means;

the pivotal member having first and second spaced projections for engaging said rope, the projections both extending generally parallel to the pivot axis with the first projection being disposed about the pivot axis and the second projection being located substantially on the opposite side of the pivot axis with respect to the connection means, the pivotal member also having a handle means to selectively pivot the pivotal member relative to the base;

the base further having a first stop defining a braking surface located adjacent the second projection which limits movement of the pivotal member; and a further, second, stop disposed adjacent the first stop at a greater distance from the second projection than the first stop, the first stop being located at a greater distance from the pivot axis than is the second stop;

whereby, in operation, the rope, adapted to pass around and between the first and second projections and between the second projection and the first stop, and between the first stop and the second stop, will have a maximum resistance force applied thereto when the handle means is released and whereby the tension on the rope will cause the second stop to bear against the rope between the braking surface and the second projection and wherein the resistance force can be controlled by moving the tail of the rope as it emerges from the descender between the first stop and the second stop.

2. A descender as claimed in claim 1 wherein the first and second projections respectively define first and second sheaves which are fixed relative to the pivotal member.

3. A descender as claimed in claim 2 wherein the second stop is disposed closer to the first sheave than is the first stop.

4. A descender as claimed in claim 1, wherein the first and second stops are generally cylindrical.

* * * * *

UNITED STATES PATENT AND TRADEMARK OFFICE

CERTIFICATE OF CORRECTION

PATENT NO. : 5,954,153
DATED : September 21, 1999
INVENTOR(S) : Rogelja

It is certified that error appears in the above-identified patent and that said Letters Patent is hereby corrected as shown below:

Column 2, line 27, "minimise" should be --minimize--.

Column 5, line 11, "is" should be --15--.

Column 3, line 11, "cain" should be --cam--.

Column 5, line 14, "ill" should be --in--.

Column 6, line 18, "on" should be --of--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*